US006211841B1

(12) United States Patent
Smith et al.

(10) Patent No.: US 6,211,841 B1
(45) Date of Patent: Apr. 3, 2001

(54) MULTI-BAND CELLULAR BASESTATION ANTENNA

(75) Inventors: Martin Smith, Chelmsford; Dean Kitchener, Brentwood; Dawn K Power, Bishops Stortford, all of (GB)

(73) Assignee: Nortel Networks Limited, Montreal (CA)

( * ) Notice: Subject to any disclaimer, the term of this patent is extended or adjusted under 35 U.S.C. 154(b) by 0 days.

(21) Appl. No.: 09/473,722

(22) Filed: Dec. 28, 1999

(51) Int. Cl.[7] ..... H01Q 21/12

(52) U.S. Cl. ..... 343/813; 343/797; 343/844; 343/853

(58) Field of Search ..... 343/813, 844, 343/797, 700 MS, 853, 810, 811, 812, 814, 815, 816, 817, 818, 819, 820, 846, 848

(56) References Cited

U.S. PATENT DOCUMENTS 3,938,161 * 2/1976 Sanford ..... 343/829
5,923,296 * 7/1999 Sanzgiri et al. ..... 343/700 MS
5,940,048 * 8/1999 Martek ..... 343/893
5,966,102 * 10/1999 Runyon ..... 343/820

* cited by examiner

*Primary Examiner*—Tho Phan
(74) *Attorney, Agent, or Firm*—Lee, Mann, Smith, McWilliams, Sweeney & Ohlson

(57) ABSTRACT

The present invention relates to a multi-band cellular basestation and in particular relates to antennas for such basestations. There is a growing need for mult-band basestation antennas for mobile communication systems, to serve existing 2nd generation systems, and emerging third generation systems. For example, GSM and DCS1800 systems currently coexist in Europe, and emerging 3rd generation systems (UMTS) will initially have to operate in parallel with these systems. The present invention provides a dual/triple/multi-band performance cellular basestation antenna having a shared aperature, having a first set of radiating elements operable at a first frequency range; a second set of radiating elements operable at a second frequency range; wherein the first set and second set of radiating elements are arranged in an interleaved fashion.

14 Claims, 4 Drawing Sheets

First embodiment of a dual polarised triband basestation antenna using two radiating layers.

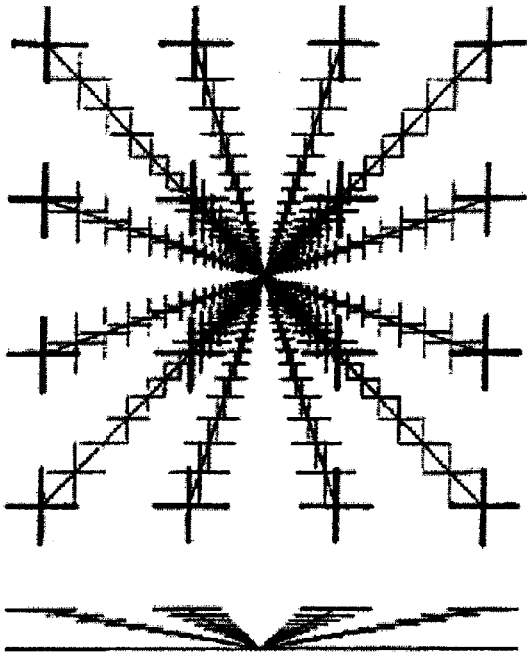
*Fig. 1a* – 4x4 3D-FIPA (Top and side views)
Prior Art
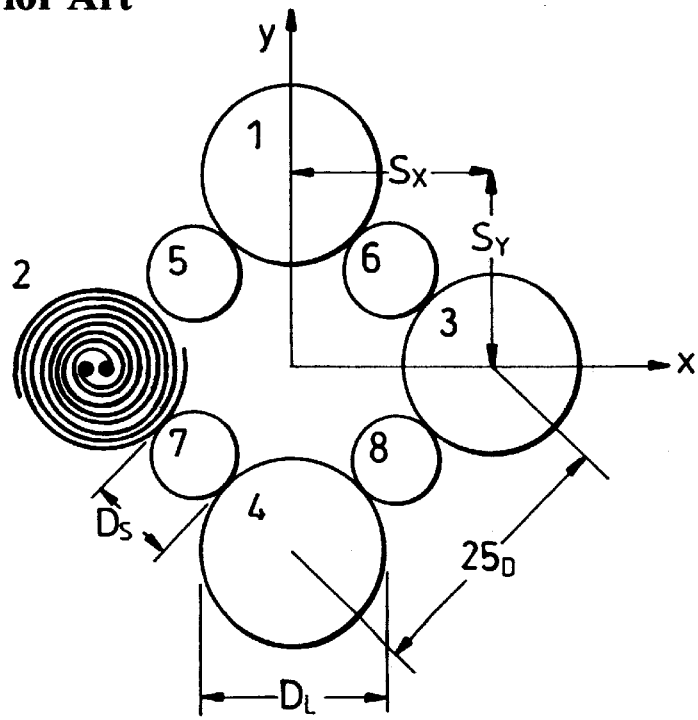
*Fig. 1b* – Wideband planar array for a two octave bandwidth
Prior Art

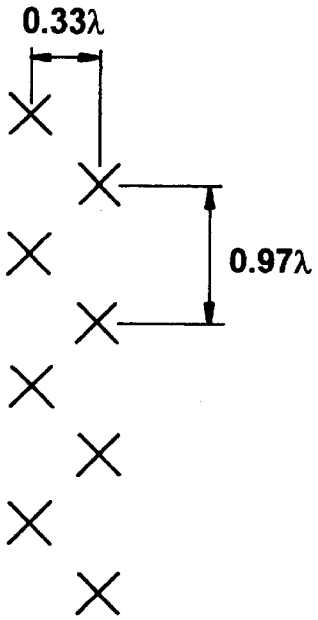
*Fig. 2* – Tricellular array – triangular lattice
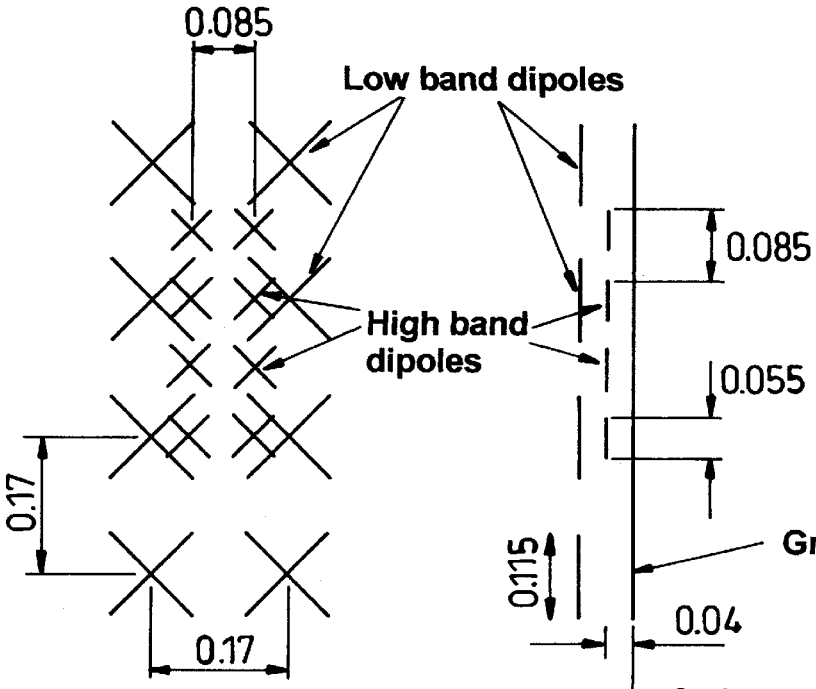
*Fig. 3a*
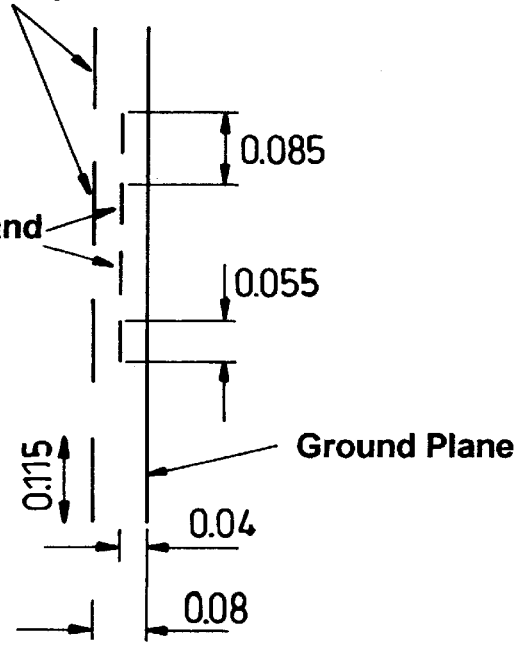
*Fig. 3b*
First embodiment of a dual polarised triband basestation antenna using two radiating layers.

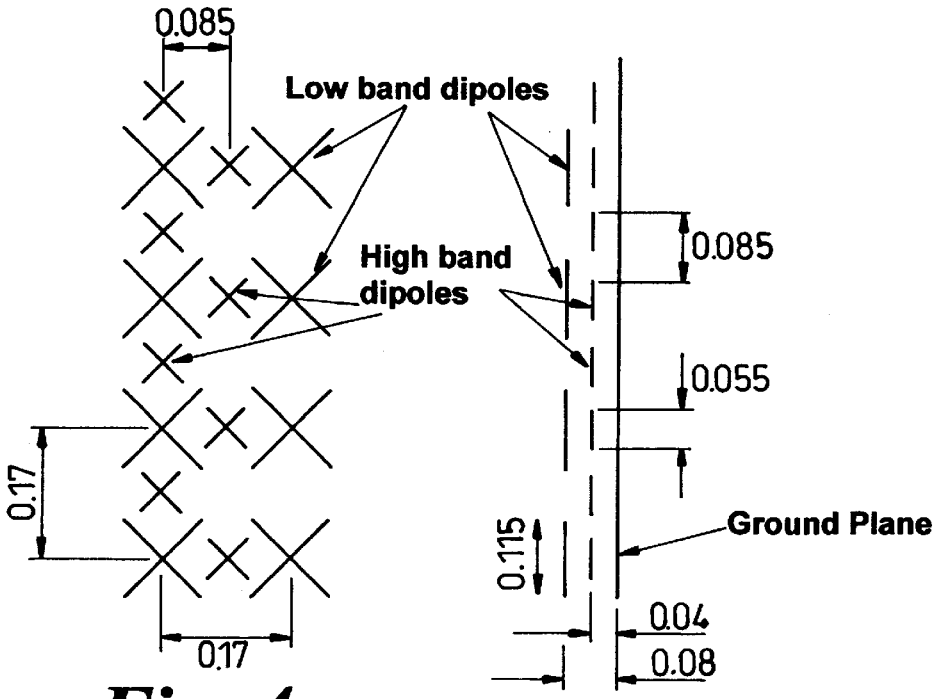
Fig. 4a
Fig. 4b
Second embodiment of a dual polarised triband basestation antenna using two radiating layers – Interleaved high band and low band arrays using a triangular lattice.
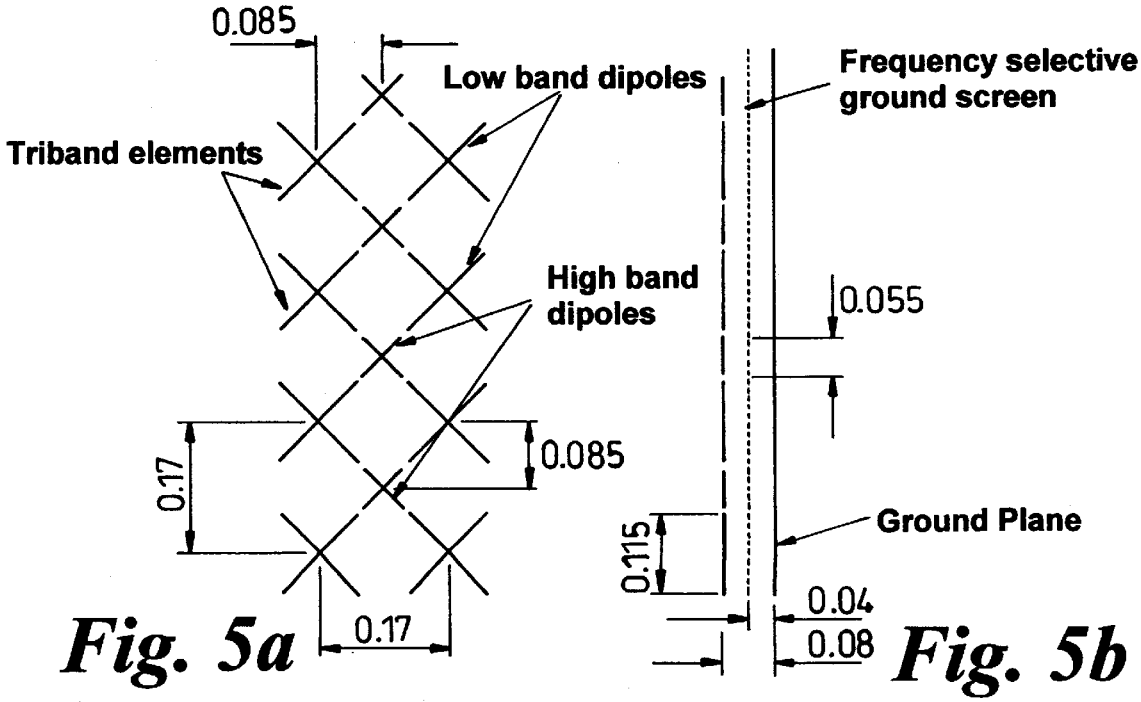
Fig. 5a
Fig. 5b
Third embodiment of a dual polarised triband basestation antenna.

λ = Low frequency wavelength $\lambda_u$ = High frequency wavelength

Multiband array with increased vertical element spacing, and high frequency elements staggered at three different horizontal positions.

MULTI-BAND CELLULAR BASESTATION ANTENNA

FIELD OF THE INVENTION

The present invention relates to a multiband cellular basestation and in particular relates to antennas for such basestations.

BACKGROUND TO THE INVENTION

There is a growing need for multiband basestation antennas for mobile communication systems, to serve existing $2^{nd}$ generation systems, and emerging third generation systems. For example, GSM and DCS1800 systems currently coexist in Europe, and emerging $3^{rd}$ generation systems (UMTS) will initially have to operate in parallel with these systems. At a given base site there may be a need to cover all three bands, and if separate antennas are used for each band this results in an unacceptably large number of antennas. Typically, two antennas are used per sector at a base site, which allows for receive diversity on the uplink. Consequently, for a base site covering all three bands this would result in 6 antennas for an omnidirectional base site, and 18 antennas for a trisector, or tricellular arrangement. The problem is similar in North America where AMPS/NADC, PCS, and $3^{rd}$ generation systems will have to coexist.

Some of the frequency bands of interest are shown in Tables 1–3. Table 1 shows the frequency bands of some first and second generation systems. Table 2 shows the IMT-2000 recommendations regarding frequency allocations for third generation systems, along with the actual spectrum availability in Europe. Table 3 shows the spectrum availability in various parts of the world compared to the IMT-2000 recommendations.

There are a number of issues to consider regarding the basestation antenna. Firstly, it would be preferred that a single structure covering all three frequency bands exists to minimise the number of antennas at any given base site. It would be preferred that the different bands should therefore have a shared aperture. The antenna structure should be designed for ease-of-manufacture and it should also be designed such that the structure has minimum cost. It is possible that antennas of different beamwidths will be required for different cell types (eg. Omni-, trisectored, tricellular, microcell) and so the design should be flexible enough to allow for this. In addition, the number of antennas can be minimised if polarisation diversity is employed rather than space diversity, such that dual polarised antenna configurations need to be considered.

Some cellular basestation antenna manufacturers have dual frequency band dual polar products, but these comprise colocated separate antennas, the separate antennas being used for the two separate bands and are simply stacked on top of each other, the antennas having been packaged as a single item or placed side by side. Vertically polarised antennas are known for use in the UMTS 1920–2170 MHz range, but commercial versions of DCS1800/UMTS cross polar antennas have yet to appear on the market. Large structures, however, are not favoured by town planners and the like: base station structures should be as small and as inconspicuous as possible.

Basestation antennas are generally array antennas, since these allow flexibility in the control of the radiation pattern. The pattern characteristics can be varied by altering the individual element amplitude and phase weights, which is useful for providing electrical downtilt, and for providing null fill-in. However, arrays are inherently narrowband because the electrical separation distance between elements changes with frequency, and this affects the array performance. In particular, if the element separation becomes too large (electrically) then grating lobes will appear in the pattern, where these are secondary main lobes. These cause a reduction in gain and an increase in the interference in the network (if they appear in the azimuth plane).

Due to the narrowband characteristics of array antennas, the use of wideband arrays has been very restricted. In the design of a wideband array, the wideband properties of the individual elements, and the wideband characteristics of the array must be considered separately.

In 'The Three-Dimensional Frequency-independent Phased Array (3D-FIPA)', J. K. Breakall, IEE Ninth International Conference on Antennas and Propagation, ICAP '95, Conference publication No. 407, pp.9–11 a design is presented for a three-dimensional frequency-independent phased array (3D-FIPA) which at the IEE ICAP '95 conference. This is achieved by applying a log-periodic principle whereby multilayer dipole arrays are formed that maintain all electrical spacings and heights over a user specified range. The design results in an antenna that maintains nearly constant pattern characteristics, gain, and VSWR over a wide bandwidth. FIG. 1 shows top and side views of the form of the array where dual polar elements (crossed dipoles) are employed. The uppermost layer of dipoles are shown emboldened to illustrate the layer that would be excited at the lowest frequency of operation.

The 3D-FIPA preserves all spacings and heights above ground (expressed in wavelengths) for active elements as the frequency is varied. However, the ground plane size does not scale with frequency but has a fixed physical size. This will introduce a frequency dependent effect on the antenna performance. In view of the three dimensional nature of the array it may become difficult to manufacture a low cost structure if many dipole layers are required.

In Wideband Arrays with variable element sizes', D. G. Shively, W. L. Stutzman, IEE Proc., Vol.137, Pt. H, No.4, August 1990 a wideband array structure is presented that operates over a two octave bandwidth. The array consists of large and small cavity-backed Archimedean spiral elements in alternate positions. The general planar case is a filled grid version of the array shown in FIG. 1*b*.

The diameter of the large spirals is twice that of the small spirals. These elements are circularly polarised and radiate when the perimeter of the spiral is approximately one wavelength. Consequently, the maximum spiral perimeter (dictated by the diameter) determines the lowest frequency of operation. As the frequency is increased, the location of the active region of the spiral moves towards the centre of the spiral. However, the aperture size does not scale with frequency, and consequently, the gain and beamwidth of the array do not remain constant with frequency. In fact, the gain increases with frequency as the beamwidth decreases and therefore is not suitable for a multiband basestation antenna.

OBJECT OF THE INVENTION

The present invention seeks to provide a dual or triple frequency band performance cellular basestation antenna having a shared aperture. The present invention also seeks to provide such an antenna which is of minimum dimensions.

STATEMENT OF THE INVENTION

In accordance with a first aspect of the invention there is provided a dual band base station antenna comprising:

a first set of radiating elements operable at a first frequency range having a centre-band wavelength $\lambda_1$;

a second set of radiating elements operable at a second frequency range having a centre-band wavelength $\lambda_2$;

and a ground plane;

wherein the first frequency range is of the order of ¼x–¾ of the second frequency range;

wherein the first set of radiating elements is arranged in two columns spaced less than $\lambda_1$ apart;

wherein the second set of radiating elements are interleaved about the two columns of the first radiating elements, the second set of radiating elements being spaced less than $\lambda_2$ apart; and wherein the elements are spaced apart from the ground plane.

The frequency bands are determined, typically, by national and supra-national regulations. The provision of a multi-band antenna reduces the size of an antenna structure such as are associated with a cellular communications basestation.

Preferably the radiating elements are spaced from the ground plane by a quarter of a wavelength at their mid-band frequency.

The second set of radiating elements can be in the same plane as the first set of radiating elements.

The radiating elements can be crossed dipoles.

The radiating elements can also be patches, single dipoles, or other suitable elements.

The radiating elements can be polarised, for example linearly or circularly polarised whereby to provide diversity.

In accordance with another aspect of the invention there is provided a method of operating a dual band base station antenna, said antenna comprising:

a first set of radiating elements operable at a first frequency range having a centre-band wavelength $\lambda_1$;

a second set of radiating elements operable at a second frequency range having a centre-band wavelength $\lambda_2$;

and a ground plane;

wherein the first frequency range is of the order of ¼–¾ of the second frequency range;

wherein the first set of radiating elements is arranged in two columns spaced less than $\lambda_1$ apart;

wherein the second set of radiating elements are interleaved about the two columns of the first radiating elements, the second set of radiating elements being spaced less than $\lambda_2$ apart; and wherein the elements are spaced apart from the ground plane.

wherein, in a transmit mode, the method comprises the steps of feeding signals to the radiating elements of a particular frequency band at an appropriate frequency whereby mutual coupling effects between the first and second sets of radiating elements allow signals to radiate effectively; and wherein, in a receive mode, the method comprises the steps of receiving incoming signals using the radiating element of a particular frequency band at an appropriate frequency whereby mutual coupling effects between the first and second sets of radiating elements allow signals to be received effectively.

BRIEF DESCRIPTION OF THE DRAWINGS

In order that the present invention can be more fully understood and to show how the same may be carried into effect, reference shall now be made, by way of example only, to the figures as shown in the accompanying drawing sheets wherein:

Table 1 shows frequency bands for some North American and European mobile communications systems;

Table 2 shows IMT frequency allocation recommendation for third generation systems;

Table 3 shows spectrum availability in various parts of the world;

Table 4 shows the variation with frequency for a wide band element array.

Table 5 shows the array performance for a triangular lattice array.

FIGS. 1*a* and *b* show first and second examples of prior art antennas;

FIG. 2 shows a tricellular array with triangular lattice.

Figure 6:
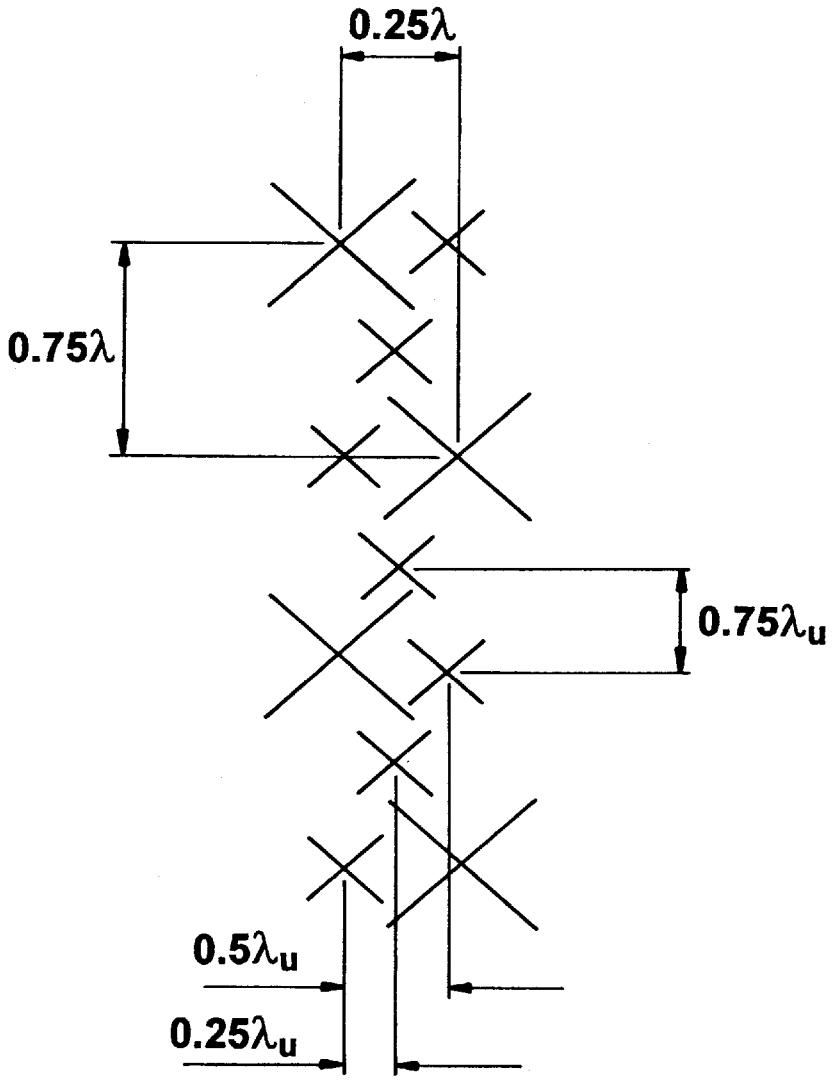
Figure 6:
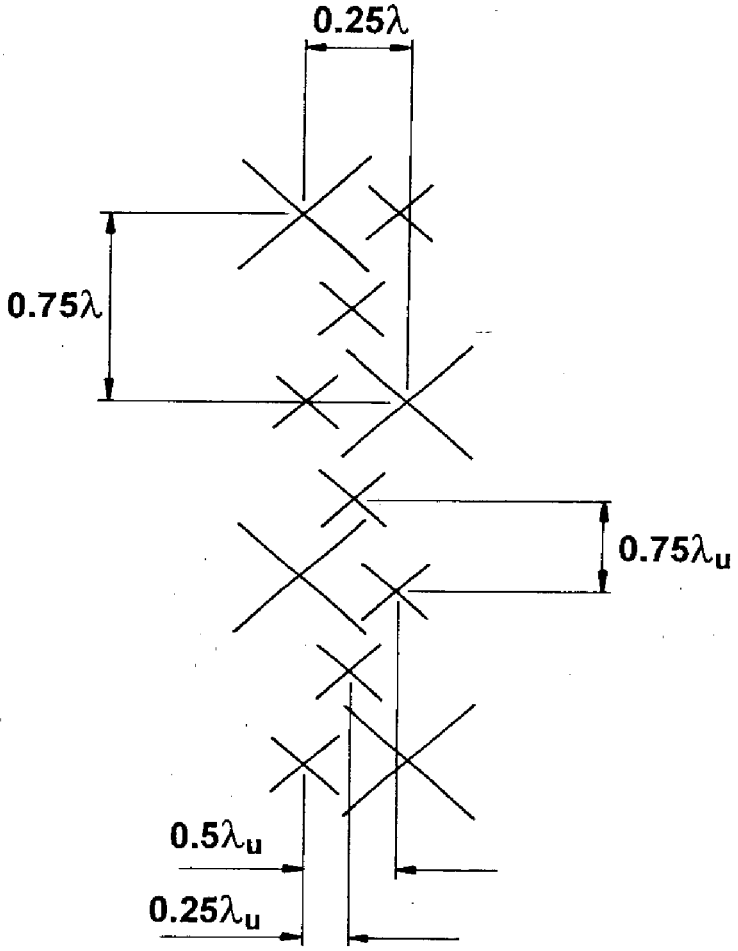

FIGS. 3*a* and *b* show a first embodiment of the present invention;

FIGS. 4*a* and *b* show a second embodiment of the present invention;

FIGS. 5*a* and *b* show a third embodiment of the present invention;

FIG. 6 shows a fourth embodiment of the present invention;

Graph 1 shows the azimuth radiation pattern for an 8 element array of dipoles spaced $\lambda/_4$ from a reflector;

Graph 2 shows the azimuth pattern for 2×8 array of dipoles at 1940 MHz

Graph 3 shows the azimuth pattern for a triangular lattice array at 1940 MHz.

Graph 4 shows the elevation pattern for a triangular lattice array at 1940 MHz.

Graph 5 shows an azimuth pattern for a straight (vertical) dipole above an infinite ground plane;

Graph 6 shows an azimuth pattern for an inclined dipole above an infinite ground plane;

Graphs 10 to 15 show the azimuth pattern at 880, 920, 960, 1710, 1940, and 2170 MHz for a second configuration of the fourth embodiment; and Graph 16 shows the azimuth pattern at 920 MHz for a third configuration of the fourth embodiment.

DETAILED DESCRIPTION OF THE INVENTION

There will now be described by way of example the best mode contemplated by the inventors for carrying out the invention. In the following description, numerous specific details are set out in order to provide a complete understanding of the present invention. It will be apparent, however, to those skilled in the art that the present invention may be put into practice with variations of the specific.

Typically, GSM basestation antennas have a gain of the order of 16 dBi, although lower gain versions are also used where, the gain of these is typically between 13–15 dBi. Azimuth 3 dB beamwidths are typically 60°–65°, although some antennas have wider beamwidths of 85°–90°. In many cases two basestation antennas have been used per sector to provide receive space diversity, and each base site would be used to serve three 120° sectors. In this configuration one of the antennas in each sector would be used as the transmit antenna as well as being used as a receive diversity antenna. This requires a diplexer at the base of the mast, and results in base sites with six antennas. Operators today are deploying dual-polarised antennas which means that only three antennas are required per base site, resulting in a much more compact configuration. The dual polarised antenna elements are at ±45°, which has become the industry standard configuration. Downtilt of the main beam of between 0°–8° is used, and the first null is generally filled in, such that it is 16–18 dB down on the peak gain. For DCS1800 antennas the specification is essentially the same except that the gain might be 18 dBi rather than 16 dBi.

The antennas used in a typical TDMA (IS-136), another $2^{nd}$ generation system, are broadly similarly with the gain similar to DCS1800 at 18 dBi. The tilt of the beam varies from 4° uptilt to 12° downtilt. The lower gain antennas that are used vary from 10 dBi to 16.5 dBi. The azimuth 3 dB beamwidths are typically 60°.

The required operational bandwidth of a threeband antenna in accordance with the invention can conveniently be considered as two distinct bands, a lower band in the range 880–960 MHz (8.7%) for GSM and an upper band in the range 1710–2170 MHz (23.7%) for DCS1800 & IMT2000. The array aperture is scaled for the two bands to preserve the radiation pattern characteristics, and to avoid grating lobes. However, whilst the element spacing must be scaled in the vertical direction to prevent grating lobes, the elevation pattern shape does not need to be preserved. The full height of the low band array can be employed to realise a higher gain in the high band, and a narrower elevation beamwidth.

FIG. 3 shows a first embodiment of the invention. The antenna comprises an upper radiating layer that serves the GSM band, where this consists of crossed dipoles (±45°) on a rectangular grid. The embodiments operate in a ±45° crossed dipole fashion, following standard manufacturing practice. For the purposes of illustration the figure shows only four elements per column, although eight or more elements would be required in order to achieve a gain of 16–18 dBi. The dipole elements in the Figure have a length of 16.3 cm, which corresponds to $\lambda/2$ at 920 MHz (centre of the GSM band). Consequently, the vertical and horizontal extent of the tilted dipole is 11.5 cm ($16.3/\sqrt{2}$). The vertical and horizontal spacing for the elements is set to 17 cm, where this corresponds to $\lambda/2$ at 880 MHz (bottom of the GSM band). The spacing from the ground plane is set to 8 cm, and this is approximately $\lambda/4$ at 880 MHz. The two radiating layers can be considered where the apertures for the different layers are scaled to suit the different operating frequency bands.

The radiating layer serving the DCS1800 and the UMTS band is situated below the GSM layer, at a distance of 4 cm from the ground plane. These elements are also arranged on a rectangular lattice. The dipole lengths in this case are 7.7 cm, which results in a horizontal and vertical extent of the tilted dipoles of 5.5 cm. The element spacing in the vertical and horizontal planes is 8.5 cm, and this corresponds to 0.48 $\lambda$ at 1710 MHz (bottom of DCS1800 band) and 0.62 $\lambda$ at 2170 MHz (top of UMTS band). If eight elements were used in the vertical direction for each radiating layer then the array length would be slightly more than 1.3 m (determined by the GSM layer). Note that the Figures are not scale drawings and the dimensions given are representative of the actual dimensions for an array with this type of structure.

The high band array under certain conditions will experience some blocking from the low band array. A second embodiment of the invention is shown in FIGS. 4*a* and *b*. In this case a triangular lattice as shown in FIG. 2 is used for the high band array, and the spacing is such that the array aperture for the high band is more sparsely populated. The same number of elements is used as for the low band array, but these are distributed in the vertical direction over the same extent as the low band elements. Consequently, the high band array aperture is only reduced (scaled) in the azimuth plane. Thus the azimuth pattern is preserved, but the elevation pattern will clearly change, although this does not necessarily represent a problem.

A computation has been made of the performance of the high band array at 1940 MHz with two columns of eight elements, and with a separation between the columns of $\lambda_{1710}/2$. The elements are distributed on a triangular lattice where the vertical separation between elements within a column is $\lambda_{1710}$ (17.5 cm). The offset between the columns in the vertical direction is then $\lambda_{1710}/2$ (8.8 cm). The computation assumed vertical dipoles spaced $\lambda_{1710}/4$ from a ground plane, and for this case the directivity of the array was computed to be 20.4 dBi, and the elevation beamwidth was approximately 60. However, the azimuth 2 dB beamwidth is only 44.7° and the 10 dB beamwidth is only 88.4°. This is too narrow for a tricellular arrangement. Other results are shown below, for the case where the horizontal separation between columns is only 0.33 $\lambda_{1710}$ (0.058 m). In this case the performance achieved is well suited for a tricellular arrangement.

The structure shown in FIGS. 4*a* and *b* could be modified such that both radiating layers are in the same plane. The radiating layer would be placed $\lambda_{880}/4$ above a solid ground plane, and a frequency selective ground plane is then introduced at a distance of $\lambda_{1710}/4$ behind the radiating layer, and such that it sits between the radiating layer and the solid ground plane. The frequency selective ground plane can comprise an array of shorted crossed dipoles, slightly longer than those present in the radiating layer, and positioned directly behind each of the high band elements. These then act as reflectors in a similar fashion to a Yagi-Uda array, and are only effective in the high band and not the low band. For the low band the solid ground plane still acts as the reflector. Note that some empirical adjustments may be required to optimise the frequency selective ground plane, where the parameters to be adjusted are the shorted dipole lengths, and the spacing from the radiating layer. Also note that this structure has the same number of layers as those of FIGS. 3*a* and *b* and FIGS. 4*a* and *b* and therefore there is no additional cost associated with having coincident radiating layers.

FIGS. 5*a* and *b* shows a third embodiment. In this case there are three columns of elements. The left hand column consists of some triband elements that serve both the low band (GSM) and the high band (DCS1800/UMTS). For operation in the high band this column is combined with the centre column, which consists of elements that are resonant in the high band but not the low band. Thus an array of elements with a triangular lattice is formed. For low band operation the left hand column of elements is combined with the right hand column, which consists of elements that are only resonant in the low band. This structure minimises the number of radiating elements required, but it means that three different element types are being employed. Also, all radiating elements will be located on the same layer, and so a frequency selective ground screen would have to be employed (if dipole-type elements are used).

A feed network for either of the above embodiments would have several layers and could be located behind the ground screen. For example, the first and second embodiment would require four separate feed layers, two for each radiating layer to accommodate the two polarisations. The number of ports on the antenna could be either two or four.

If two ports are required to limit the number of coaxial cables running down the mast, then a splitter/combiner arrangement would have to be integrated into the antenna.

A further array configuration is shown in FIG. 6 in which the interleaved arrays of the lower and upper frequencies use two and three columns, respectively with 0.25 wavelength azimuth spacing, and 0.75 wavelength elevation spacing. This spacing can be varied from half of a wavelength to one wavelength.

The feature of several interleaved or criss crossed columns of low and high band elements, allows the combination of the two upper bands into one, while maintaining a reasonably constant azimuth beamwidth. The closer spacing of the columns in this array has been found to counteract the narrowing of the pattern due to the use of slant dipoles. This allows an increase in the elevation spacing from 0.5 to 0.75 wavelengths, which creates more room for the interleaved elements. The closer azimuth spacing however does not allow two column interleaving for the two bands, hence the three columns for the upper band. The azimuth weighting of the columns, controlled by the number of occupied positions in each column, has changed from 1:1 to 1:2:1. The tapered three column aperture has a similar beamwidth to the untapered two column case.

The dipoles are half wavelength in length at the centre of each band, approximately 0.16 m and 0.08 m. The elements are each spaced 0.25 wavelengths from the ground plane, i.e. at 0.08 m and 0.04 m respectively. The low band elements effectively ignore the smaller high band elements which are closer to the ground plane than them. However the high band elements are affected by parasitic coupling to the larger low band dipoles which are forward of them. These parasitic excitations perturb the high band azimuth patterns, particularly at the lowest part of the upper frequency band. The azimuth beamwidth in this part of the band can be narrow. This problem can be overcome by lengthening the low band dipole, which is counterintuitive, to shift the problem out of band. The low band dipole is now greater than one wavelength long across the upper band, which stops the parasitic effect from narrowing the azimuth beam. The low band dipole is electrically too long, and a matching circuit is required to compensate for any inductive reactance in the low band. The length of the low frequency dipoles can be increased from 0.16 to 0.18 m to push parasitic interaction out of the band of interest, as shown in graph 13.

For a tricellular arrangement an azimuth 2 dB beamwidth of 60° is required, and ideally a 10 dB beamwidth of approximately 120° (assuming a path loss exponent of 3.5), since for a tricellular arrangement, the range to the cell boundary varies with angle. At the ±60° points relative to boresight the range is half that on boresight. Assuming a $(1/r^n)$ path loss law the difference in path loss is:

$$10n\log(2r)-10n\log(r)=10n\log(2)$$

For n=3.5, which is a typical value for urban environments, 10nlog(2)=10.5 dB.

Consequently, in this case the antenna 10 dB beamwidth needs to be 120° to provide reasonably uniform coverage throughout the cell.

What is claimed is:

1. A dual band base station antenna comprising:

a first set of radiating elements operable at a first frequency range having a centre-band wavelength $\lambda_1$ and a centre-band frequency $f_1$;

a second set of radiating elements operable at a second frequency range having a centre-band wavelength $\lambda_2$ and a centre-band frequency $f_2$;

and a ground plane;

wherein the centre-band frequency $f_1$ of the first frequency range is of the order of ¼–¾ of the centre-band frequency $f_2$ of the second frequency range;

wherein the first set of radiating elements is arranged in two columns spaced less than $\lambda_1$ apart;

wherein the second set of radiating elements are interleaved around the two columns of the first set of radiating elements, the second set of radiating elements being spaced less than $\lambda_2$ apart; and wherein the elements are spaced apart from the ground plane.

2. An antenna in accordance with claim 1 wherein the first set of radiating elements are spaced from the ground plane by approximately a quarter of a wavelength at centre-band frequency $f_1$ and wherein the second set of radiating elements are spaced from the around plane by approximately a quarter of a wavelength at centre-band frequency $f_2$.

3. An antenna in accordance with claim 1 wherein the second set of radiating elements are in the same plane as the first set of radiating elements.

4. An antenna in accordance with claim 1 wherein the first and second sets of radiating elements are dipoles.

5. An antenna in accordance with claim 1 wherein the first and second sets of radiating elements are dual polarized.

6. An antenna in accordance with claim 1 wherein the first and second sets of radiating elements are crossed dipoles.

7. An antenna as claimed in claim 6 wherein the dipoles of the first set of radiating elements are arranged to be greater than one wavelength long, in the frequency range of the second set of radiating elements, and wherein a matching circuit is provided which is arranged to compensate for any inductive reactance in the frequency range of the first set of radiating elements.

8. An antenna in accordance with claim 1 wherein the frequency bands are determined by national regulations.

9. An antenna according to claim 1 wherein the frequency bands comprise three operating bands, two of which are amalgamated.

10. An antenna in accordance with claim 1 wherein either one or both of the frequency bands comprise two distinct operating bands, wherein the centre-band frequency is the average of the lowest frequency in the lower frequency operating band and the highest frequency in the upper frequency operating band.

11. A base station equipped with a dual band antenna comprising a first set of radiating elements operable at a first frequency range having a centre-band wavelength $\lambda_1$ and a centre-band frequency $f_1$;

a second set of radiating elements operable at a second frequency range having a centre-band wavelength $\lambda_2$ and a centre-band frequency $f_2$;

and a ground plane;

wherein the centre-band frequency $f_1$ of the first frequency range is of the order of ¼–¾ of the centre-band frequency $f_2$ of the second frequency range;

wherein the first set of radiating elements is arranged in two columns spaced less than $\lambda_1$ apart;

wherein the second set of radiating elements are interleaved around the two columns of the first set of radiating elements, the second set of radiating elements being spaced less than $\lambda_2$ apart; and wherein the elements are spaced apart from the around plane.

12. A method of operating a dual band antenna, said antenna comprising:

a first set of radiating elements operable at a first frequency range having a centre-band wavelength $\lambda_1$ and centre-band frequency $f_1$;

a second set of radiating elements operable at a second frequency range having a centre-band wavelength $\lambda_2$ and a centre-band frequency $f_2$;

and a ground plane;

wherein the centre-band frequency $f_1$ of the first frequency range is of the order of ¼–¾ of the centre-band frequency $f_2$ of the second frequency range;

wherein the first set of radiating elements is arranged in two columns spaced less than $\lambda_1$ apart;

wherein the second set of radiating elements are interleaved around the two columns of the first radiating elements, the second set of radiating elements being spaced less than $\lambda_2$ apart; and wherein the first and second sets of elements are spaced apart from the ground plane;

wherein, in a transmit mode, the method comprises the steps of feeding signals to either of the first and second sets of radiating elements; and wherein, in a receive mode, the method comprises the steps of receiving incoming signals using either of the first and second sets of radiating elements.

13. A method according to claim 12 wherein the antenna is a cellular communications base station antenna.

14. A method according to claim 12 wherein polarisation is employed as a signal discriminant.

* * * * *

UNITED STATES PATENT AND TRADEMARK OFFICE

CERTIFICATE OF CORRECTION

PATENT NO. : 6,211,841 B1
DATED : April 3, 2001
INVENTOR(S) : Martin Smith et al.

It is certified that error appears in the above-identified patent and that said Letters Patent is hereby corrected as shown below:

The title page should be deleted and substitute therefore the attached title page.

Drawings,
Delete Drawing sheets Figs. 1a, 1b, 2, 3a, 3b, 4a, 4b, 5a, 5b, and 6 and substitute therefore Figs. 1a, 1b, 2, 3a, 3b, 4a, 5a, 5b and 6 as shown on the attached pages.

Delete Tables 1 to 5 and substitute therefore Tables 1 - 5 as shown on the attached pages.

Delete Graphs 1-6 and 10-16 and substitute therefore Graphs 1-6 and 10-16 as shown on the attached pages.

Signed and Sealed this

Ninth Day of November, 2004

JON W. DUDAS
*Director of the United States Patent and Trademark Office*

(12) United States Patent
Smith et al.

(10) Patent No.: US 6,211,841 B1
(45) Date of Patent: Apr. 3, 2001

(54) MULTI-BAND CELLULAR BASESTATION ANTENNA

(75) Inventors: Martin Smith, Chelmsford; Dean Kitchener, Brentwood; Dawn K Power, Bishops Stortford, all of (GB)

(73) Assignee: Nortel Networks Limited, Montreal (CA)

( * ) Notice: Subject to any disclaimer, the term of this patent is extended or adjusted under 35 U.S.C. 154(b) by 0 days.

(21) Appl. No.: 09/473,722

(22) Filed: Dec. 28, 1999

(51) Int. Cl.[7] ..... H01Q 21/12

(52) U.S. Cl. ..... 343/813; 343/797; 343/844; 343/853

(58) Field of Search ..... 343/813, 844, 343/797, 700 MS, 853, 810, 811, 812, 814, 815, 816, 817, 818, 819, 820, 846, 848

(56) References Cited

U.S. PATENT DOCUMENTS 3,938,161 * 2/1976 Sanford ..... 343/829
5,923,296 * 7/1999 Sanzgiri et al. ..... 343/700 MS
5,940,048 * 8/1999 Martek ..... 343/893
5,966,102 * 10/1999 Runyon ..... 343/820

* cited by examiner

*Primary Examiner*—Tho Phan
(74) *Attorney, Agent, or Firm*—Lee, Mann, Smith, McWilliams, Sweeney & Ohlson

(57) ABSTRACT

The present invention relates to a multi-band cellular basestation and in particular relates to antennas for such basestations. There is a growing need for mult-band basestation antennas for mobile communication systems, to serve existing 2nd generation systems, and emerging third generation systems. For example, GSM and DCS1800 systems currently coexist in Europe, and emerging 3rd generation systems (UMTS) will initially have to operate in parallel with these systems. The present invention provides a dual/triple/multi-band performance cellular basestation antenna having a shared aperature, having a first set of radiating elements operable at a first frequency range; a second set of radiating elements operable at a second frequency range; wherein the first set and second set of radiating elements are arranged in an interleaved fashion.

14 Claims, 4 Drawing Sheets

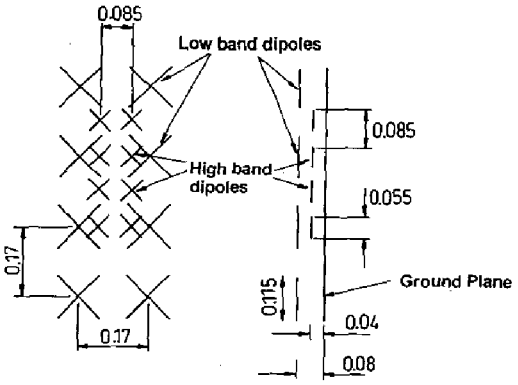

First embodiment of a dual polarised triband basestation antenna using two radiating layers.

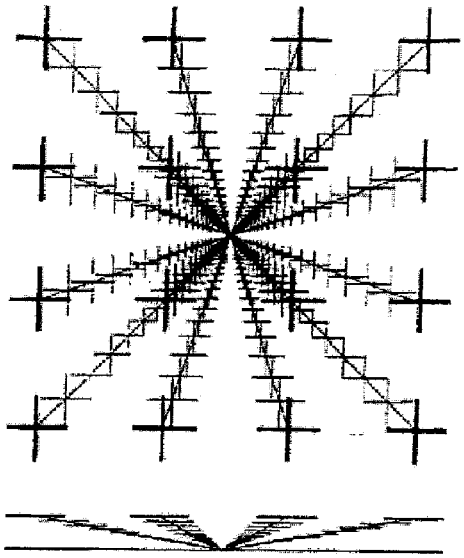
*Fig. 1a* – 4x4 3D-FIPA (Top and side views)
Prior Art
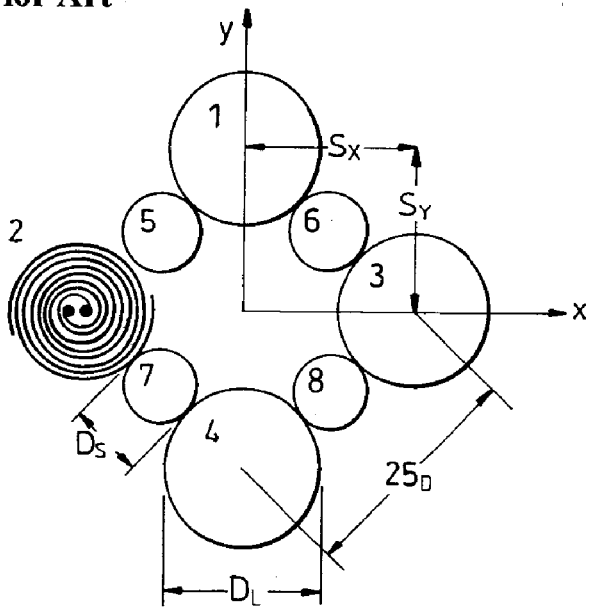
*Fig. 1b* – Wideband planar array for a two octave bandwidth
Prior Art

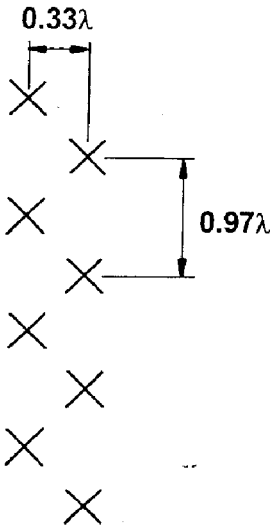
*Fig. 2* – Tricellular array – triangular lattice
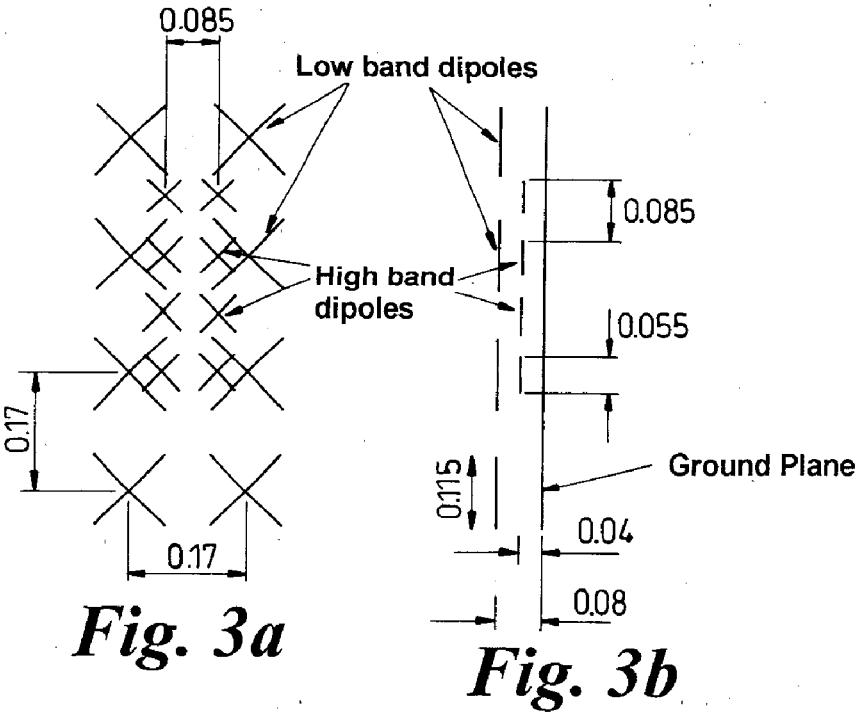
*Fig. 3a* *Fig. 3b*
First embodiment of a dual polarised triband basestation antenna using two radiating layers.

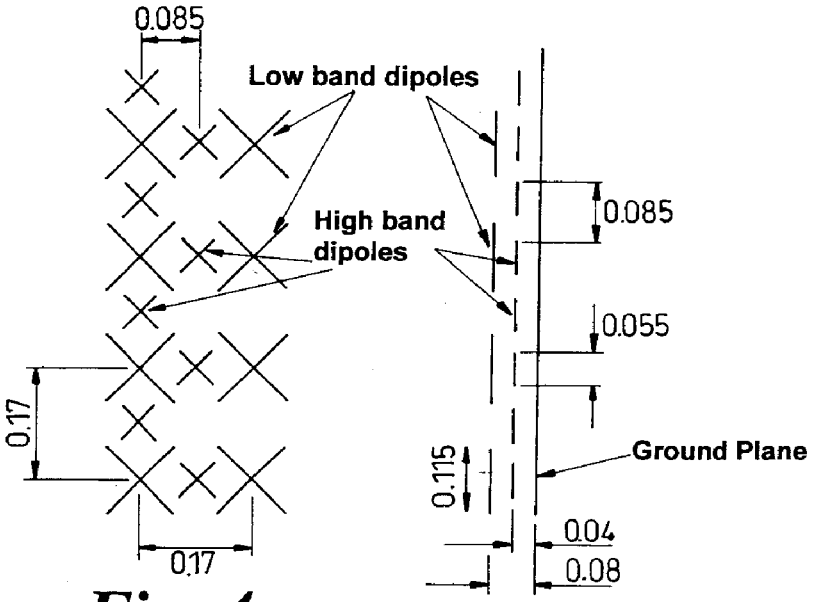
Fig. 4a
Fig. 4b
Second embodiment of a dual polarised triband basestation antenna using two radiating layers – Interleaved high band and low band arrays using a triangular lattice.
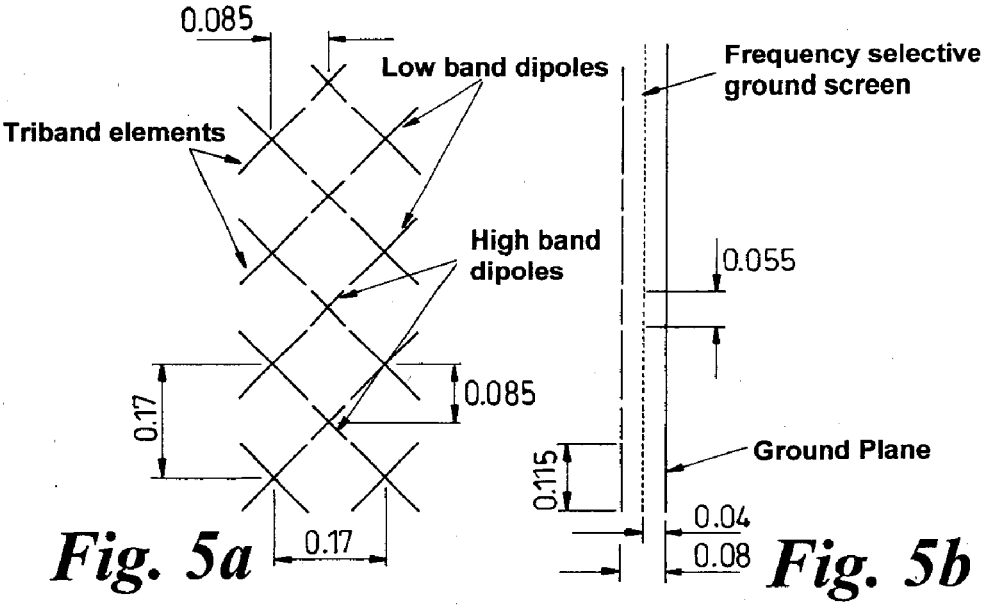
Fig. 5a
Fig. 5b
Third embodiment of a dual polarised triband basestation antenna.

λ = Low frequency wavelength $\lambda_u$ = High frequency wavelength

Multiband array with increased vertical element spacing, and high frequency elements staggered at three different horizontal positions.

| System | |
|---|---|
| AMPS & NADC (IS-54/136)<br>North America | Rx 869-894<br>Tx 824-849 |
| PCS<br>North America | Rx 1930-1990<br>Tx 1850-1910 |
| GSM<br>Europe | Rx 925-960<br>Tx 880-915 |
| DCS1800<br>Europe | Rx 1805-1880<br>Tx 1710-1785 |

Prior Art

Table 1 – Frequency bands for some North American and European mobile communications systems

*CEPT ERC Task Group 1 (UMTS)*
(1)
Spectrum Requirements, Spectrum Availability
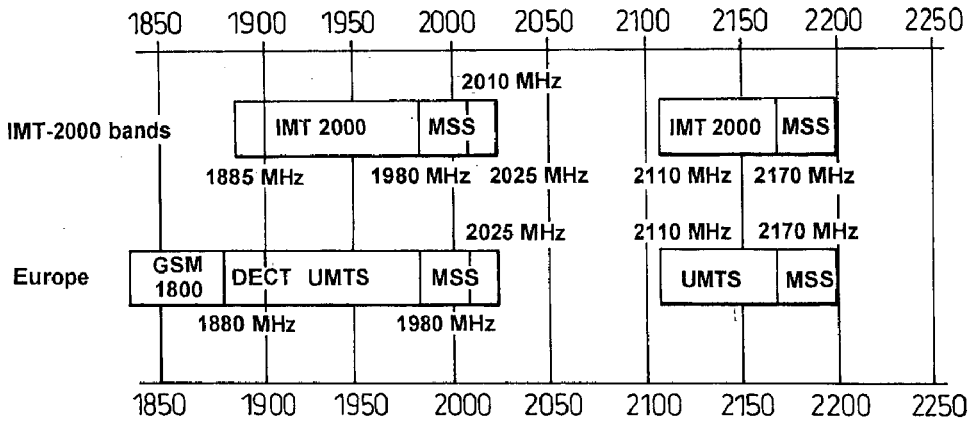
IMT 2000 Workshop
Jersey, Channel Islands
10 –11 November 1998
Prior Art
Table 2 showing IMT-2000 spectrum allocation, and European spectrum availability

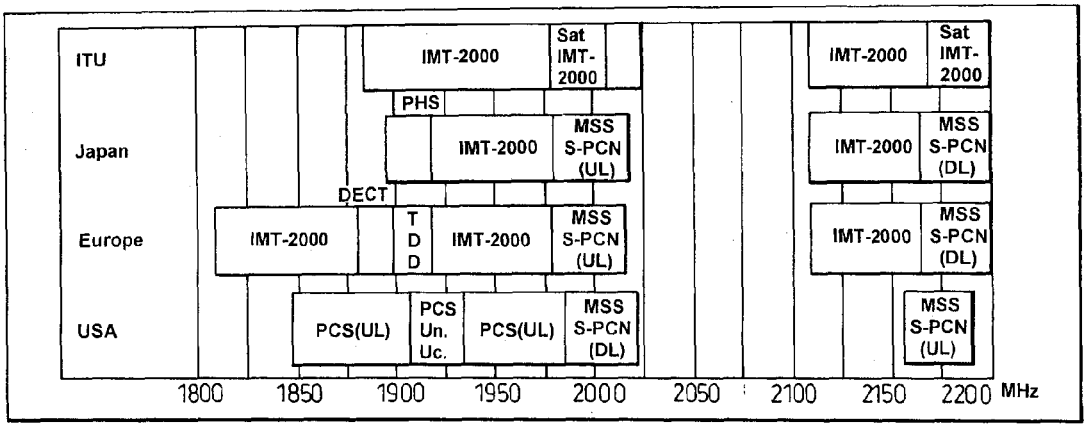
Table 3 – IMT2000 frequency allocations
Prior Art

| | 1710MHz | 1940MHz | 2170MHz |
|---|---|---|---|
| Directivity/dBi | 15.3 | 15.5 | 15.7 |
| Azimuth 3dB beamwidth | 112.5° | 119.9° | 126.8° |
| Elevation 3dB beamwidth | 10.3° | 9.1° | 7.9° |

Table 4 – Trisectored array characteristics: variation with frequency

| Frequency/GHz | Directivity/dBi | 2dB Azimuth beamwidth (Degrees) | 10dB Azimuth beamwidth (Degrees) | Gain at ±60° points relative to boresight dB |
|---|---|---|---|---|
| 1.71 | 18.5 | 65.0° | 132.1° | -7.9 |
| 1.94 | 19.1 | 63.1° | 127.4° | -8.6 |
| 2.17 | 19.4 | 61.5° | 121.5° | -9.7 |

Table 5 – Array performance for triangular lattice array

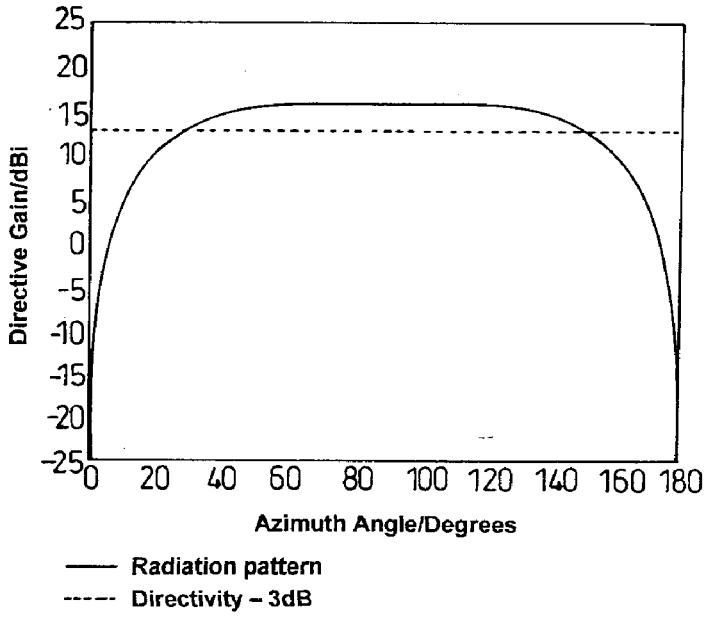
Graph 1 – Azimuth radiation pattern for 8 element array of dipoles spaced λ/4 from a reflector
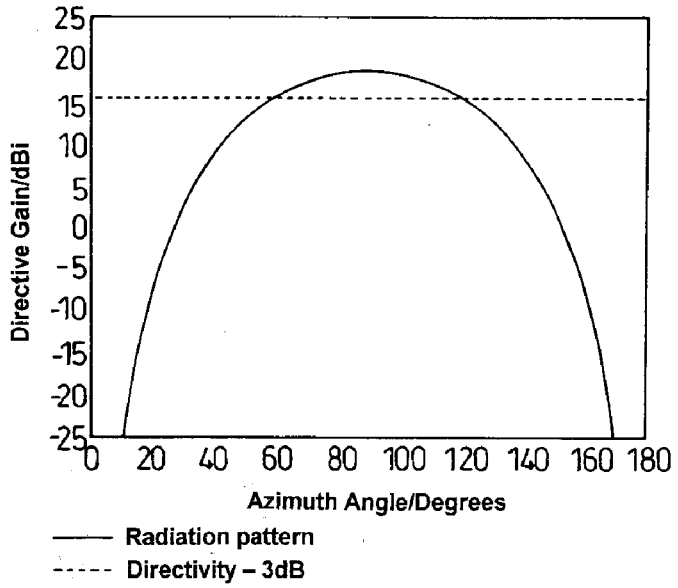
Graph 2 – Azimuth pattern for 2x8 array of dipoles at 1940MHz

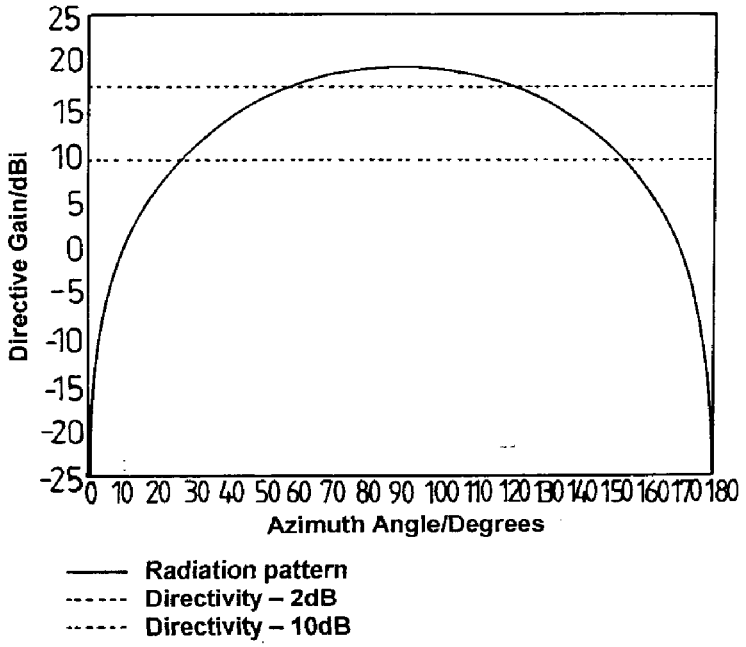
Graph 3 – Azimuth pattern of triangular lattice array at 1940MHz
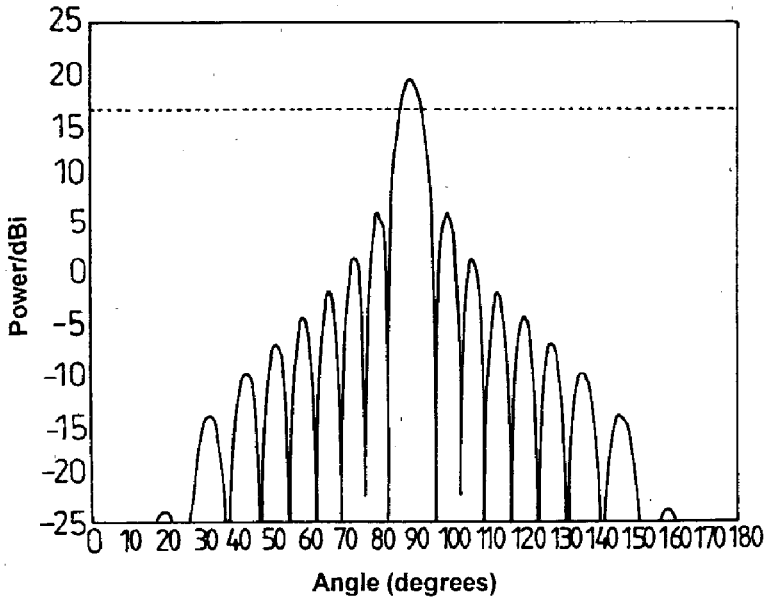
Graph 4 – Elevation pattern of triangular lattice array at 1940MHz

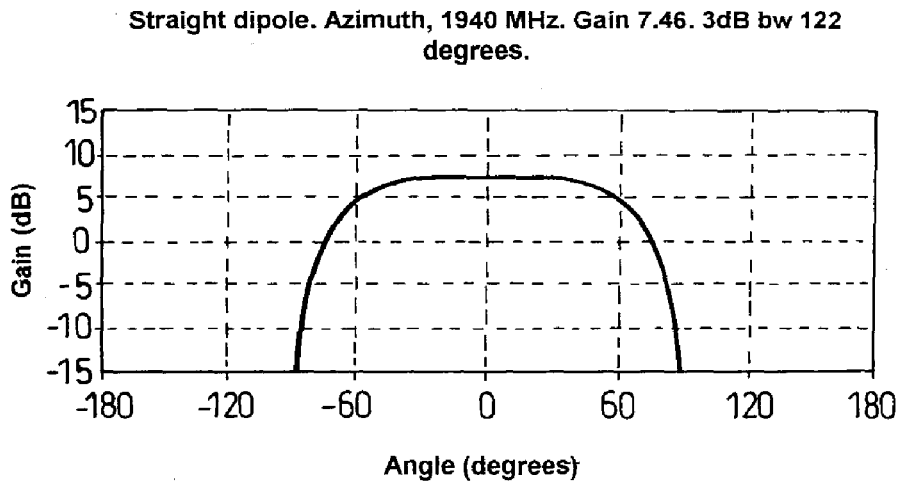
Graph 5: Azimuth pattern for a straight dipole above an infinite ground plane.
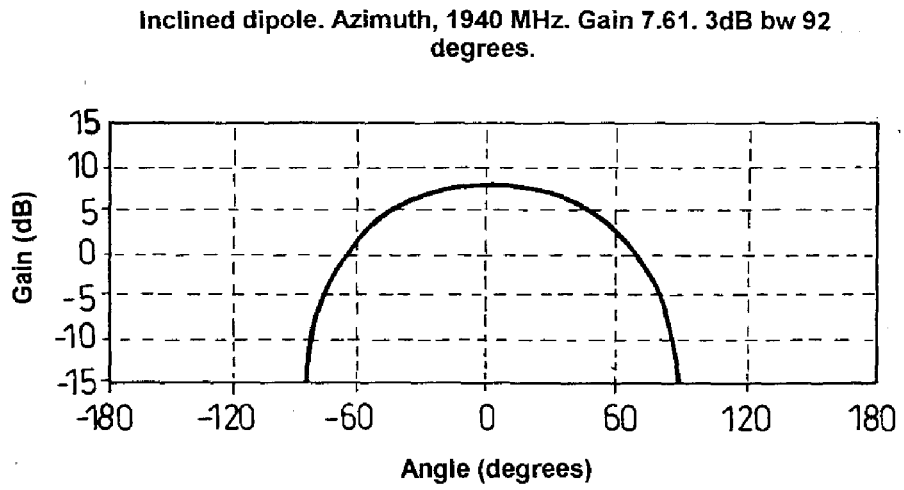
Graph 6: Azimuth pattern for an inclined dipole above an infinite ground plane.

High and low frequency elements. Azimuth, 880MHz. Gain 17.2.
2dB beam width 52.5°, 3dB beam width 64.5°, 10dB beam width 125°.
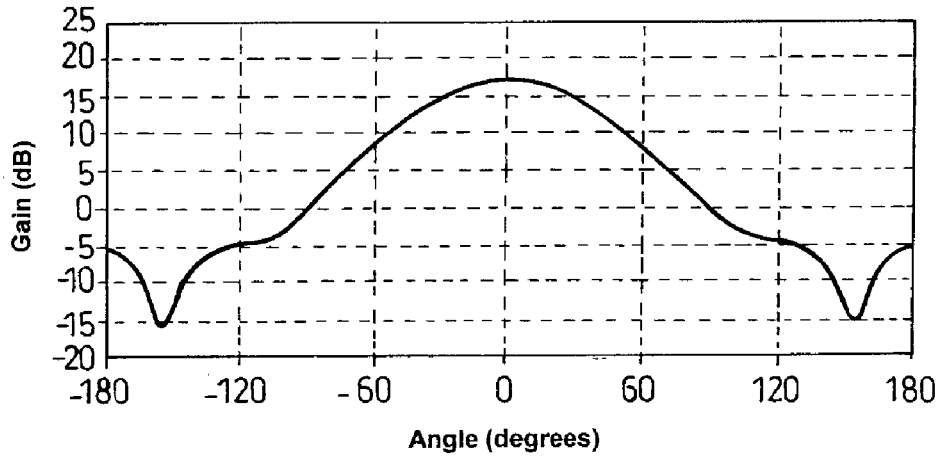
Graph 10
High and low frequency elements. Azimuth, 920MHz. Gain 17.31.
2dB beam width 51.5°, 3dB beam width 64.5°, 10dB beam width 123°.
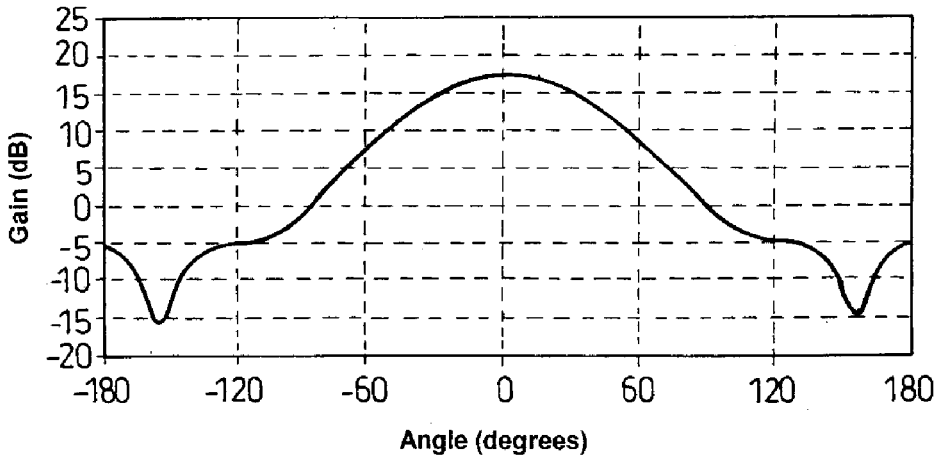
Graph 11

High and low frequency elements. Azimuth, 960MHz. Gain 17.35.
2dB beam width 51°, 3dB beam width 63°, 10dB beam width 121.5°.
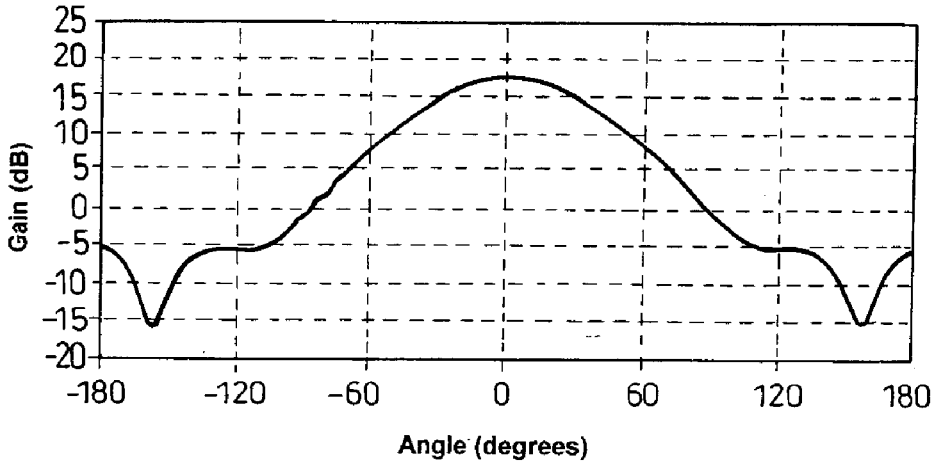
Graph 12
High and low frequency elements. Azimuth, 1710MHz. Gain 19.72.
2dB beam width 59.5°, 3dB beam width 69°, 10dB beam width 117°.
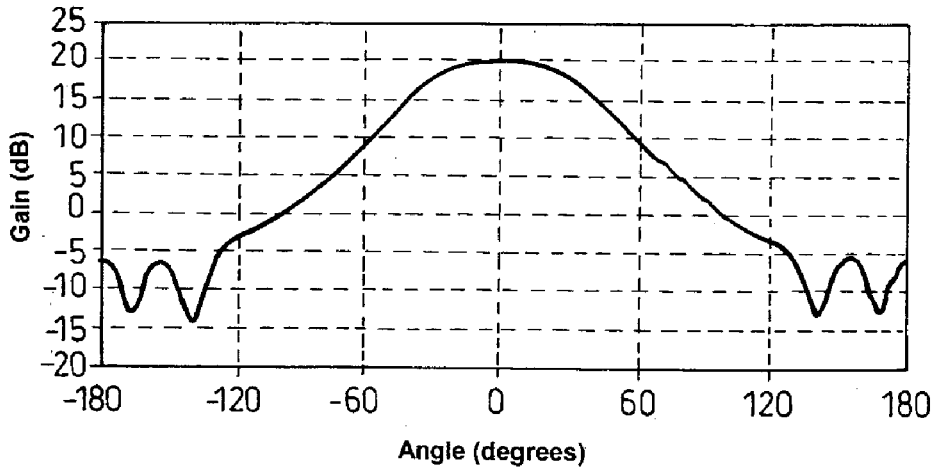
Graph 13

High and low frequency elements. Azimuth, 1940MHz. Gain 19.7.
2dB beam width 66°, 3dB beam width 75.5°, 10dB beam width 123.5°.
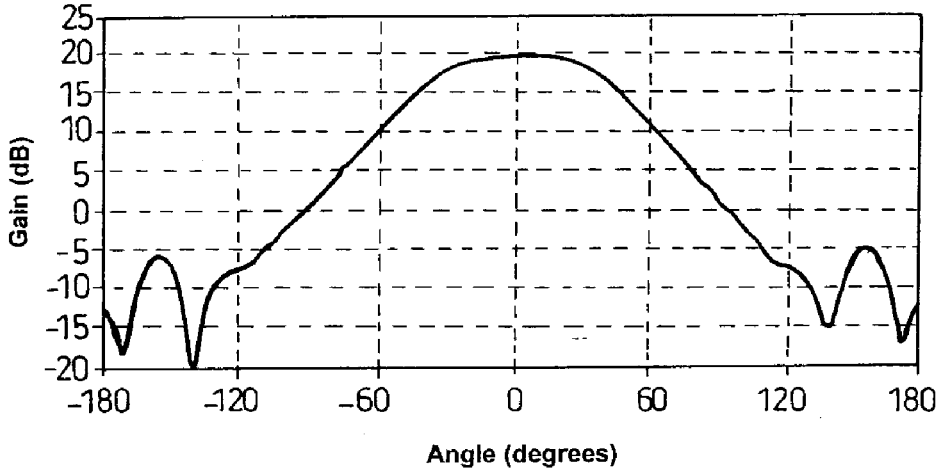
Graph 14
High and low frequency elements. Azimuth, 2170MHz. Gain 19.74.
2dB beam width 59°, 3dB beam width 72.5°, 10dB beam width 129.5°.
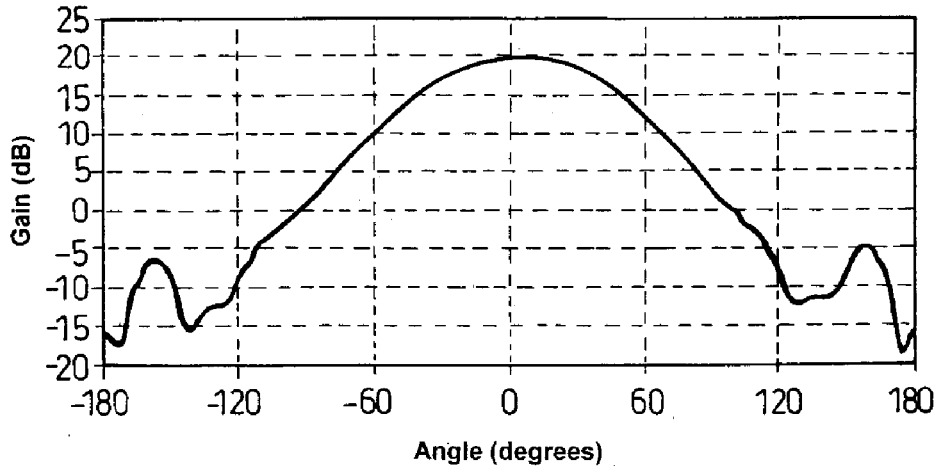
Graph 15

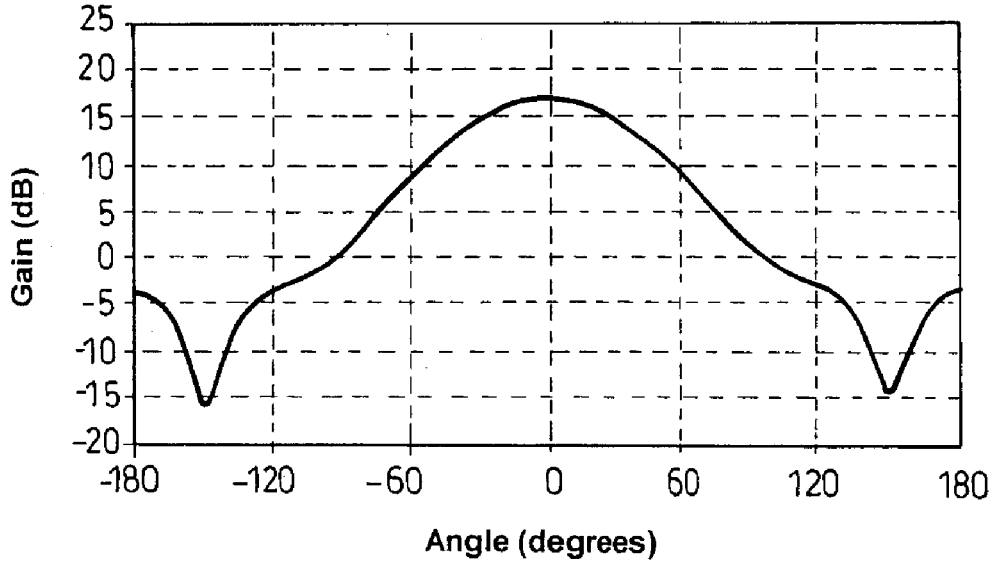
High and low frequency elements. Azimuth pattern, 920MHz, Gain 17.04dBi, 2dB beam width 55.5°, 3dB beam width 68.5°, 10dB beam width 131°
Graph 16